US005881697A

United States Patent [19]

Schott et al.

[11] Patent Number: 5,881,697

[45] Date of Patent: Mar. 16, 1999

[54] METHOD FOR ADJUSTING A SUPPLEMENTAL QUANTITY OF FUEL IN THE WARM-UP PHASE OF AN INTERNAL COMBUSTION ENGINE

[75] Inventors: Bernd Schott, Freiberg; Klaus Joos, Walheim; Ralf Klein, Wimpfen, all of Germany

[73] Assignee: Robert Bosch GmbH, Stuttgart, Germany

[21] Appl. No.: 873,291

[22] Filed: Jun. 11, 1997

[30] Foreign Application Priority Data

Jun. 28, 1996 [DE] Germany ..... 196 25 928.2

[51] Int. Cl.[6] ..... F02M 51/00

[52] U.S. Cl. ..... 123/491

[58] Field of Search ..... 123/491, 684

[56] References Cited

U.S. PATENT DOCUMENTS

| | | | |
|---|---|---|---|
| 4,205,635 | 6/1980 | Kirn et al. | 123/491 |
| 5,408,975 | 4/1995 | Blakeslee et al. | 123/491 |
| 5,507,265 | 4/1996 | Ichikawa et al. | 123/491 |
| 5,586,544 | 12/1996 | Kitamura et al. | 123/684 |
| 5,601,064 | 2/1997 | Fujimoto et al. | 123/491 |
| 5,605,138 | 2/1997 | Deichsel et al. | 123/491 |
| 5,647,324 | 7/1997 | Nakajima | 123/491 |
| 5,690,074 | 11/1997 | Ogawa | 123/491 |

*Primary Examiner*—Raymond A. Nelli
*Attorney, Agent, or Firm*—Walter Ottesen

[57] ABSTRACT

The invention is directed to a method for adjusting a supplemental quantity of fuel which is supplied to an internal combustion engine during warm-up operation in addition to a basic quantity measured for an operationally warm engine. The method includes the step of basing the adaptation of the supplemental quantity of fuel on an evaluation of the control actuating variable of an idle speed control.

5 Claims, 4 Drawing Sheets

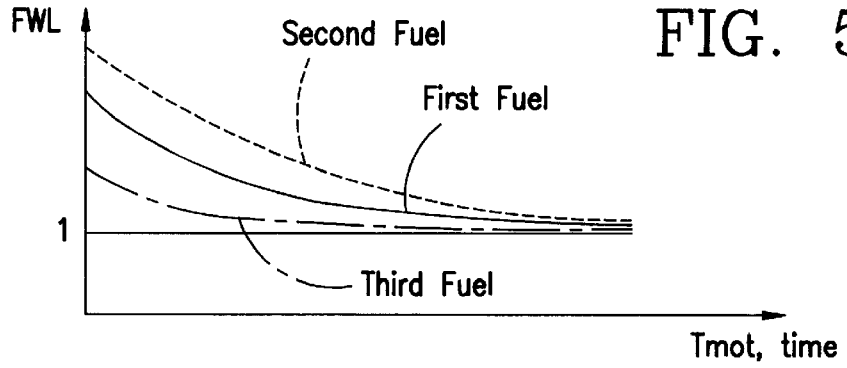
FIG. 5
FIG. 7
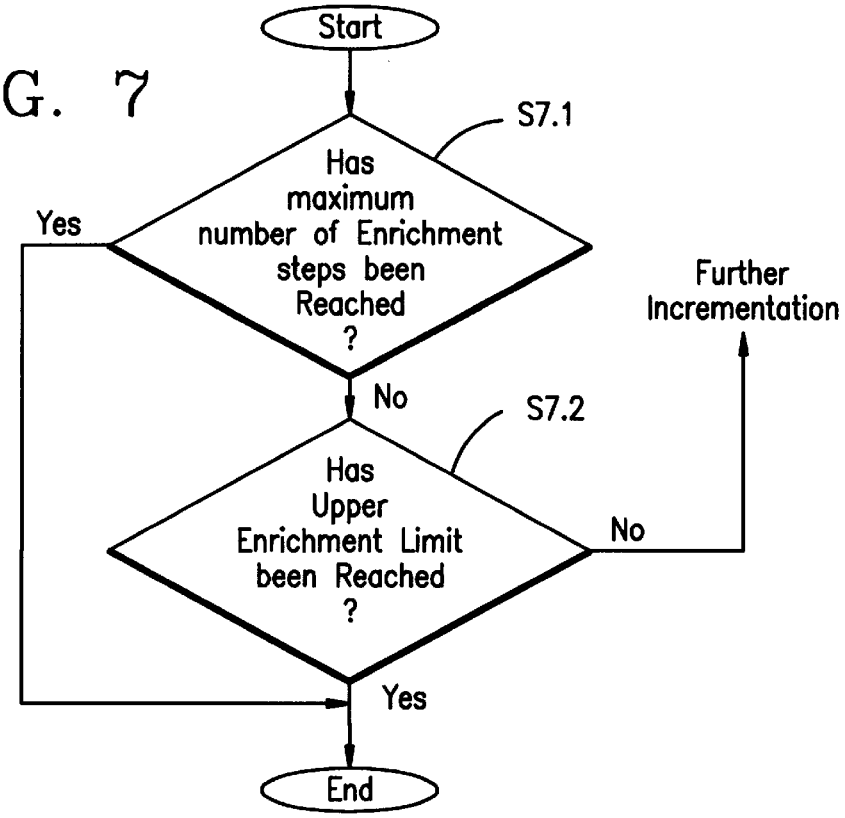
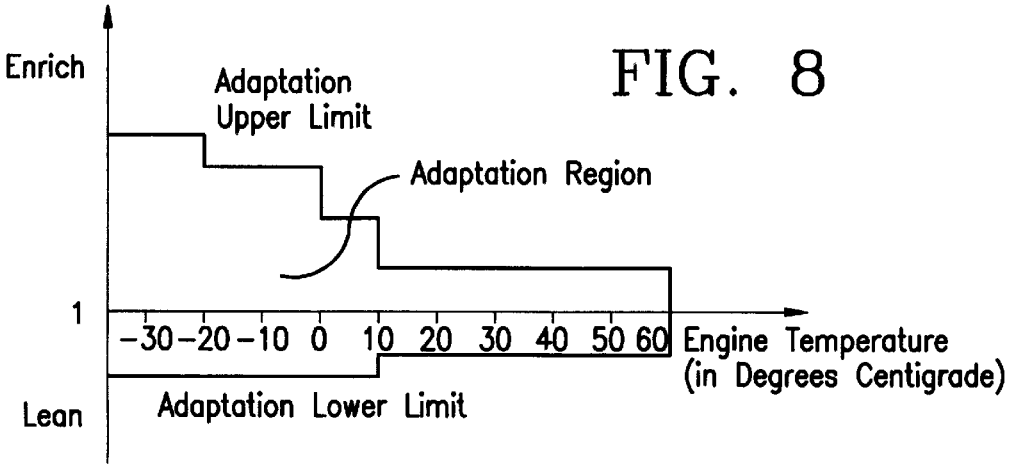
FIG. 8

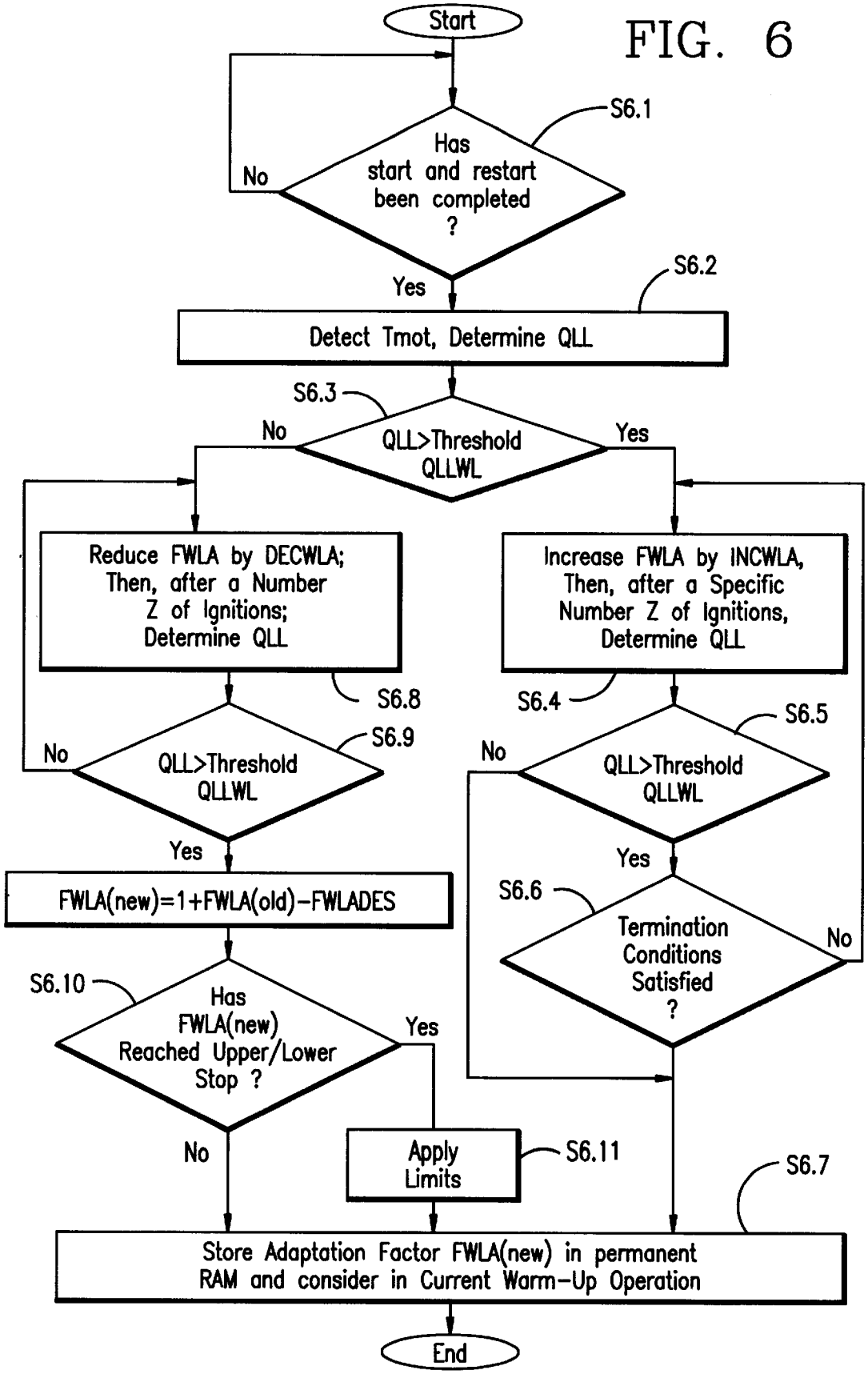
FIG. 6
Start
S6.1
Has start and restart been completed ?
No
Yes
S6.2
Detect Tmot, Determine QLL
S6.3
QLL>Threshold QLLWL
No
Yes
Reduce FWLA by DECWLA; Then, after a Number Z of Ignitions; Determine QLL
S6.8
Increase FWLA by INCWLA, Then, after a Specific Number Z of Ignitions, Determine QLL
S6.4
S6.9
QLL>Threshold QLLWL
No
Yes
S6.5
QLL>Threshold QLLWL
No
Yes
FWLA(new)=1+FWLA(old)−FWLADES
S6.6
Termination Conditions Satisfied ?
No
S6.10
Has FWLA(new) Reached Upper/Lower Stop ?
Yes
No
Apply Limits
S6.11
S6.7
Store Adaptation Factor FWLA(new) in permanent RAM and consider in Current Warm-Up Operation
End

METHOD FOR ADJUSTING A SUPPLEMENTAL QUANTITY OF FUEL IN THE WARM-UP PHASE OF AN INTERNAL COMBUSTION ENGINE

FIELD OF THE INVENTION

The invention relates to a method for adjusting a supplemental quantity of fuel which is supplied to an engine during warm-up operation in addition to a basic quantity measured for the operation of a warm engine subsequent to the warm-up operation.

BACKGROUND OF THE INVENTION

Known methods adjust a supplemental quantity of fuel during warm-up which is comparatively large at the start and is reduced in accordance with a predetermined function with increasing duration of the warm-up and therefore with increasing warming of the engine. At the latest, no supplemental quantity of fuel is supplied any more when the operating temperature of the engine is reached. U.S. Pat. No. 4,205,635 discloses an example of this known method.

The necessity of a warm-up enrichment by increasing the quantity of fuel is caused by the so-called wall-film losses. These losses occur because a portion of the fuel injected into the intake pipe of the engine condenses on the inner wall surfaces of the intake pipe and forms a fuel wall film. This portion of the injected fuel is not available for combustion in the cylinder. Its magnitude is also determined by the condensation behavior and boiling behavior of the fuel used. The fuel quantity injected during warm-up is increased in order to obtain a desired fuel/air ratio $\lambda$ notwithstanding the wall-film effect.

In accordance with the known method, the warm-up enrichment takes place in a controlled manner such that a specific fuel quality leads to a desired $\lambda$ in the cylinder. A comparatively lean warm-up adaptation is advantageous for present day exhaust-gas strategies. For the comparatively lean warm-up adaptation, driving problems can occur because of a mixture which is too lean because of seasonal and regionally fluctuating qualities of fuel or even because of changes of the through-flow characteristic of the injection valve caused by deterioration. A conventional lambda control cannot eliminate these problems because it is not active during warm-up for various reasons.

SUMMARY OF THE INVENTION

In view of this background, it is an object of the invention to provide a method which facilitates an adaptation of the warm-up enrichment to the actual requirement of the internal combustion engine.

The method of the invention is for adjusting a supplemental quantity of fuel which is supplied to an internal combustion engine during warm-up operation in addition to a basic quantity measured for an operationally warm engine. The method includes the step of basing the adaptation of the supplemental quantity of fuel on an evaluation of the control actuating variable of an idle speed control.

A special advantage of the invention is that the adaptation of the warm-up enrichment is based on an evaluation of the control actuating variable of an idle speed control. The method of the invention requires no additional structural components because such a control is generally a part of an entire system of modern engine controls. The invention can therefore be integrated into the existing body of functions. The invention makes possible a warm-up adaptation without tying in the lambda control. Thermoshock problems for the lambda probe do not occur.

BRIEF DESCRIPTION OF THE DRAWINGS

The invention will now be described with reference to the drawings wherein:

FIG. 5 shows the background of the method of the invention;

FIG. 6 shows a further embodiment of the method of the invention in the context of a flowchart;

FIG. 7 supplements the flowchart of FIG. 6; and,

FIG. 8 shows the trace of limits within which the method of the invention operates.

DESCRIPTION OF THE PREFERRED EMBODIMENTS OF THE INVENTION

Figure 1:
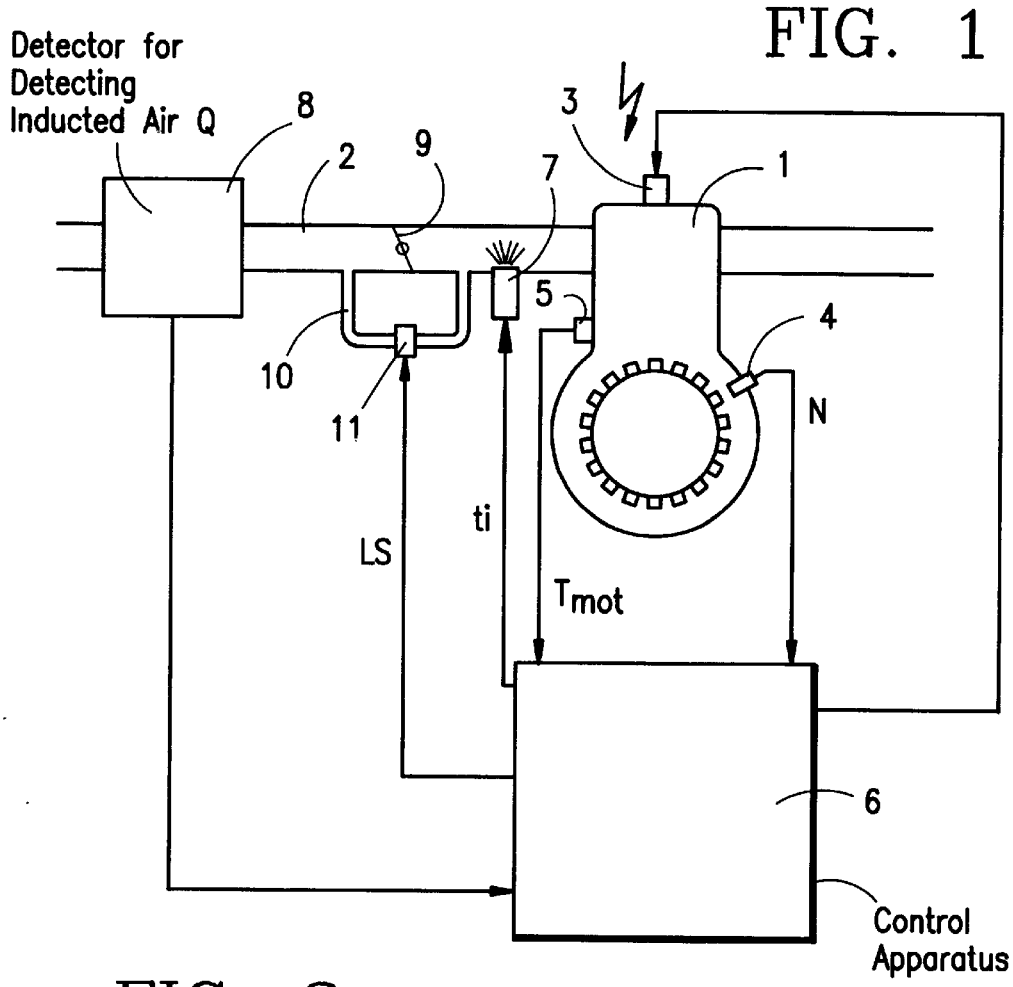
FIG. 1 shows the background in which the method of the invention is applied.

Referring to FIG. 1, an internal combustion engine 1 includes an intake pipe 2, an ignition system 3, means 4 for detecting the rpm of the engine, means 5 for detecting the temperature of the engine and a control apparatus 6. The intake pipe 2 includes fuel metering means 7, means 8 for detecting the inducted air quantity Q, a throttle flap 9 as well as a throttle flap bypass 10, having an actuating element 11 for controlling the idle rpm by varying the air supply to the engine when the throttle flap is closed. A function of the control apparatus 6 is to meter the correct quantity of fuel in proportion to the quantity Q of the inducted air. This takes place, for example, by computing injection pulsewidths ti proportional to Q/n * (various enrichments/corrective factors)+(additive corrections). If the corrections, which are unessential in connection with the invention, are omitted, then such an injection pulsewidth can, for example, have the following form:

ti proportional to Q/n * FWL wherein:

FWL=FWL0 (Tmot, Q, n) * FWLA.

This case is taken as an example and, for this assumed case, FWL0 should decrease with increasing engine temperature so that the warm-up enrichment continuously decreases and is ineffective when the engine is operationally warm.

Figure 2:
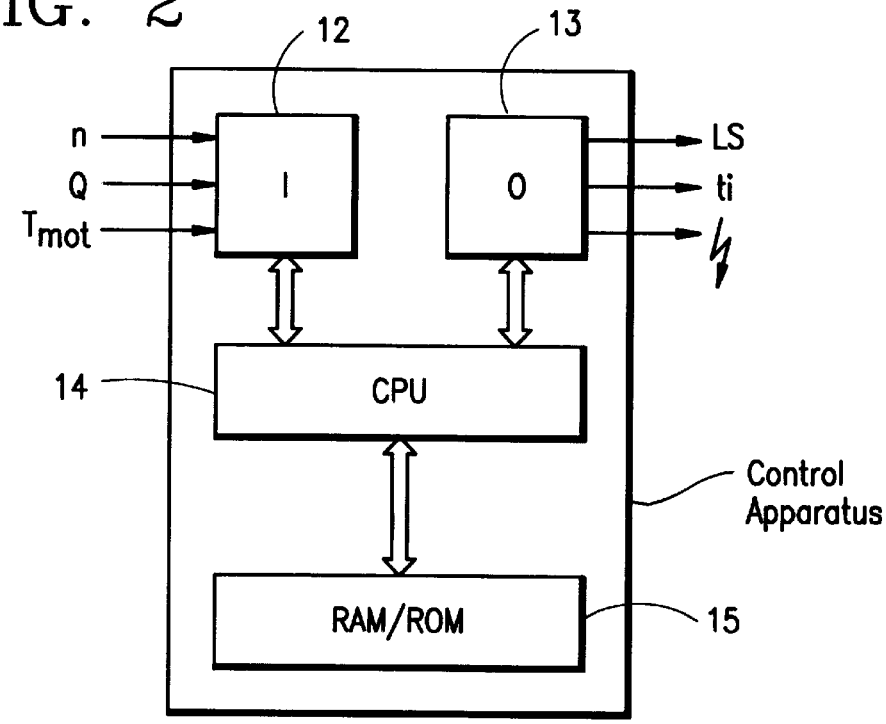
FIG. 2 explains the principle of a control apparatus suitable for controlling the method of the invention.

FIG. 2 explains the basic function of a control apparatus 6 suitable for controlling the method of the invention. At least those input signals shown are supplied to an input block 12 and the output block 13 outputs, for example, the output signals shown. A computer 14 arbitrates between the input block 12 and the output block 13 in accordance with programs and data stored in the memory 15.

Figure 3:
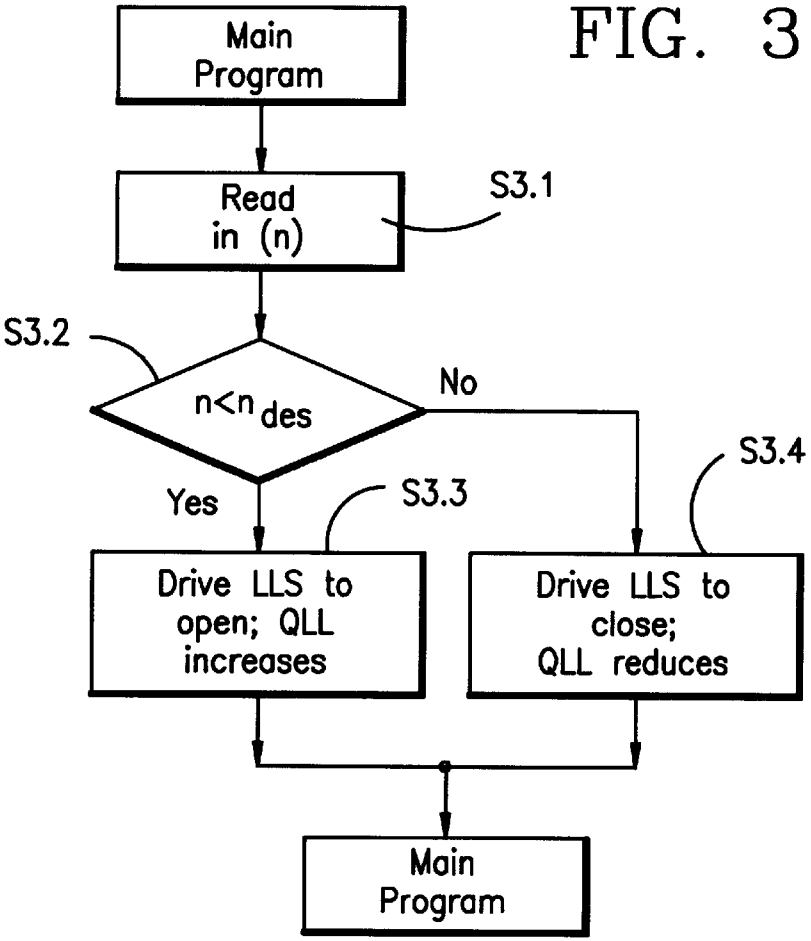
FIG. 3 shows the operation of a known idle speed control.

The flowchart of FIG. 3 provides an example of the known idle control method which can serve as the basis of the method of the invention. A subprogram comprising steps S3.1 to S3.4 is taken from a higher-order main program. In step S3.1, the actual rpm (n) is read in. The actual rpm is compared to a desired rpm value $n_{des}$ in step S3.2. When the actual value is less than the desired value, an idle actuating element LLS (for example, the actuating member 11 in FIG. 1) is driven so that it opens (step S3.3). As a consequence, the quantity of air QLL inducted by the engine increases and this leads to an increase of the rpm (n). If, in contrast, the rpm actual value is greater than a desired value, then the program branches to step S3.4 wherein the idle air quantity QLL is reduced by driving the actuating member 11 in the closing direction thereof. A return to the main program takes place after the actuating member is driven. Repeating this step sequence in a predetermined raster leads to the situation that the rpm adjusts, on average, to the wanted desired value.

Figure 4:
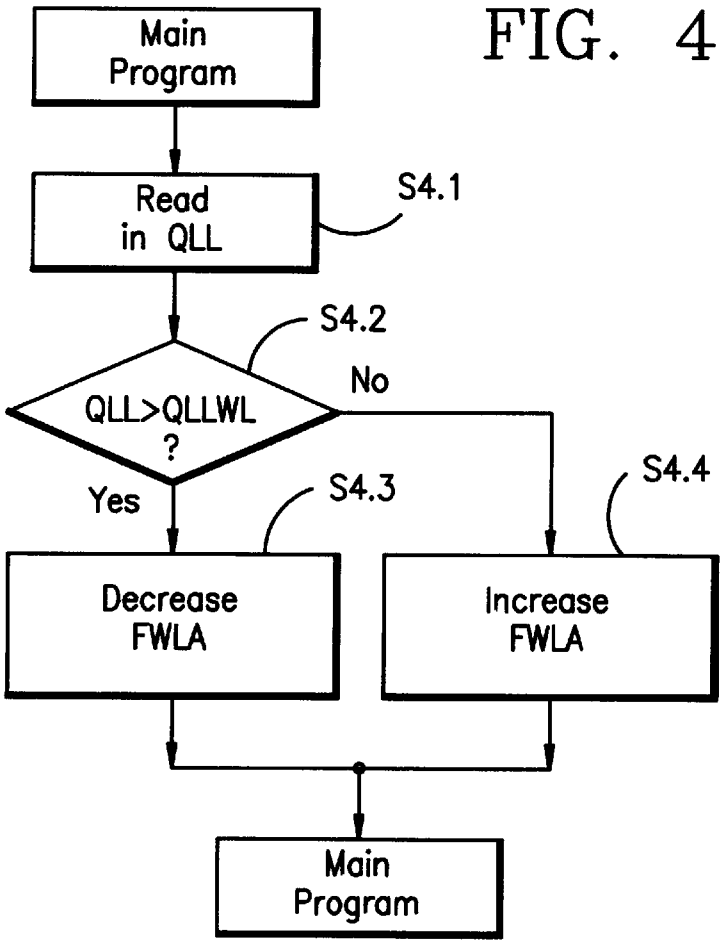
FIG. 4 shows a first embodiment of the method of the invention in the context of a flowchart.

FIG. 4 shows a first embodiment of the invention. Here, step S4.1 is accessed from a higher-order main program. In step S4.1, the idle air quantity QLL is read in. Thereafter, in step S4.2, a check is made as to whether the air quantity QLL, which is inducted during idle, exceeds a predetermined threshold value QLLWL for the warm-up operation. If this is the case, then the quantity FWLA is decreased (step S4.3); otherwise, this quantity FWLA is increased (step S4.4). Since the quantity FWLA influences the fuel quantity multiplicatively, step S4.3 operates to increase and step S4.4 operates to reduce the fuel metered during warm-up of the engine.

The above procedure is based on the relationships described below.

On the one hand, to maintain a desired idle rpm, a certain power is required to overcome friction resistance which develops during combustion of the cylinder charge. The energy which can be used during the combustion, is dependent upon the quantity and quality of the cylinder charge. Accordingly, the power, for example, decreases for the otherwise same conditions in the quality range of $\lambda>0.9$ with increasing $\lambda$. The warm-up factor FWL0 is so determined for a first fuel that, in idle, a desired lambda value of, for example, $\lambda=1.05$ adjusts at an inducted air quantity QLLWL. A $\lambda$ of 1.2 first adjusts when using a second fuel. The idle control increases the quantity of the cylinder charge in order to reach the desired idle speed notwithstanding the power loss connected with this quality change. This is noted by the inquiry step S4.2 which is followed by a change of the quality of the cylinder charge by step S4.3 in that the fuel quantity is increased. When utilizing a third fuel, which first would result in a $\lambda$ of 0.95, for example, the method of the invention leads, via the steps S4.1, S4.2 and S4.3, to a reduction of the metered fuel. By repeatedly running through the step sequence of FIG. 4, the metered fuel automatically adjusts in the warm-up operation so that the quality of the cylinder charge approaches a desired lambda value, for example, $\lambda=1.05$. The invention thereby effects an adaptation of the warm-up enrichment to the requirement of the engine which changes with fluctuating fuel quality.

A warm-up enrichment factor FWL is a measure for the requirement of the engine and is plotted in FIG. 5 as a function of engine temperature Tmot. The plot is for the three above-mentioned fuel qualities. The solid line corresponds to the first fuel, which leads to the desired lambda of, for example, 1.05 during warm-up. The dash line corresponds to the use of the second fuel, which would lead to a lean warm-up mixture without countermeasures and requires a larger warm-up factor FWL for compensation. In the same manner, the dash-dot line corresponds to the third fuel, which would lead to a rich mixture without countermeasures and requires, for compensation, a comparatively low warm-up factor FWL. The invention effects an adaptation, that is, an adaptation of the warm-up enrichment to the fuel characteristics.

A further embodiment of the method of the invention is presented in FIG. 6. After start and restart (step S6.1), the idle air quantity QLL of the engine is determined for a specific engine temperature Tmot in step S6.2. If QLL is greater than the threshold QLLWL (step S6.3), which corresponds to this engine temperature, then it can be assumed that the mixture is too lean. An increase of the warm-up adaptation factor FWLA then takes place with a specific step amount INCWLA in step S6.4. After an elapse of a specific number Z of ignitions, a check is again made in step S6.5 as to whether QLL is still greater than the threshold QLLWL. If this is the case, then FWLA can again be increased by the step amount INCWLA, et cetera. Step S6.6 serves to check the interruption conditions as they are shown in FIG. 7.

Accordingly, for example, in step S7.1, a check can be made as to whether an upper limit for the number of enriching steps is reached and/or whether, in a step S7.2, an enrichment upper limit is reached. As long as these inquiries are answered in the negative, then further incrementation can be made and, when this inquiry is answered in the positive, the increase of FWLA is interrupted.

In step S6.7, the warm-up adaptation factor FWLA is stored for the present temperature range for use in subsequent driving cycles and, in the actual driving cycle, can be applied, for example, multiplicatively to the warm-up factor.

If QLL in step S6.3 is less than the threshold QLLWL, which corresponds to the corresponding engine temperature, then it can be assumed that the mixture still makes acceptable driving possible. The possibility of a precise warm-up adaptation now exists. For this purpose, the warm-up adaptation factor number FWLA is decremented in step S6.8 by the decrement DECWLA, and, after each Z of ignitions, the quantity QLL is determined. By repeatedly running through steps S6.8 and S6.9, this takes place until the idle air quantity threshold QLLWL is reached. When this threshold is reached, a new warm-up factor FWLA(new) is formed in step S6.10.

This step sequence is based on the following: the idle air quantity threshold QLLWL corresponds to that idle air quantity which is required for a specific engine temperature and a very lean mixture so that the idle desired rpm is maintained. As long as the quantity QLL is less than the quantity QLLWL, the mixture quality is still sufficient to maintain the desired rpm. In this case, leaning continues in stepped amounts until the value QLLWL is reached. The number of steps for leaning the mixture with a known step width (extent of decrement) provides a measure for the deviation of the actual mixture composition $\lambda$ during warm-up from the operating limit which is defined by the idle air quantity threshold QLLWL. (This operating limit is set between good running of the engine and where the engine stalls.)

By newly forming the warm-up factor according to step S6.10, the warm-up mixture again receives the wanted original spacing to the operating limit. FWLA(new) is the newly formed warm-up adaptation factor and FWLA(old) is the warm-up adaptation factor which was decremented step-wise to the idle air quantity limit. FWLADES is the desired value to which the warm-up factor FWLA can be decremented for the fuel with which the basic adaptation was carried out. The new adaptation factor FWLA(new) is stored for the corresponding temperature range in the permanent RAM (step S6.7). The steps S6.11 and S6.12 serve to limit the adaptation. In this way, the danger of an incorrect learning is reduced. FIG. 8 qualitatively shows the dependency of the permitted adaptation range on the engine temperature.

It is understood that the foregoing description is that of the preferred embodiments of the invention and that various changes and modifications may be made thereto without departing from the spirit and scope of the invention as defined in the appended claims.

What is claimed is:

1. A method of adjusting an air/fuel mixture composition supplied to an internal combustion engine in the time that said engine warms up to normal operating temperature, the engine including a control apparatus for controlling the idle rpm of said engine by generating a first actuating variable (QLL) for adjusting the air supplied to the engine and for adjusting a second actuating variable (ti) for adjusting the fuel metered to the engine for adjusting the air/fuel mixture, said control apparatus having a computer and the fuel having quality which can change from time to time as different fuels are used to operate the engine, the method comprising;

reading in said first actuating variable (QLL) into said computer of said control apparatus;

comparing said first actuating variable (QLL) to a threshold value (QLLWL) to obtain a comparison value; and, operating on said second actuating variable (ti) in dependence upon said comparison value thereby increasing or decreasing said second actuating variable (ti) thereby adapting said air/fuel mixture to reach a desired lambda value corresponding to the quality of the fuel used.

2. The method of claim 1, wherein said first actuating variable (QLL) is representative of an idle air, quantity (QLL), and said second actuating variable (ti) is representative of a quantity of fuel; and, wherein the method comprises:

reading in said idle air quantity (QLL) inducted during idle;

checking to determine if said air quantity (QLL) exceeds said threshold value (QLLWL) predetermined for said warm-up operation; and, if said air quantity (QLL) exceeds said threshold value (QLLWL), then increasing said quantity of fuel and, if said air quantity (QLL) drops below said threshold value (QLLWL), then decreasing said quantity of fuel.

3. The method of claim 1, wherein said first actuating variable (QLL) is representative of an idle air quantity (QLL) and said second actuating variable (ti) is representative of a quantity of fuel; and, wherein the method comprises:

detecting an idle air quantity (QLL) of said engine at a specific engine temperature (Tmot);

comparing said idle air quantity (QLL) to a threshold (QLLWL) assigned to said engine temperature (Tmot); and, increasing said quantity of fuel when said air quantity (QLL) is greater than said threshold (QLLWL).

4. The method of claim 1, wherein said first actuating variable (QLL) is representative of an idle air quantity (QLL) and said second actuating variable (ti) is representative of a quantity of fuel; and, wherein the method comprises:

storing a measure (FWLA) for the adapted quantity of fuel in the existing temperature range for use in subsequent driving cycles; and, multiplicatively influencing the fuel quantity in the current driving cycle with said measure (FWLA).

5. The method of claim 1, wherein said first actuating variable (QLL) is representative of an idle air quantity (QLL) and said second actuating variable (ti) is representative of a quantity of fuel; and, wherein the method comprises:

reading in an idle air quantity (QLL) inducted during idle;

checking whether said idle air quantity (QLL) drops below a threshold value (QLLWL) of the idle air quantity, which is predetermined for warm-up operation and which occurs in the region of the operating limit of said engine;

in the event that said idle air quantity (QLL) drops below said threshold value (QLLWL), reducing said quantity in increments until said threshold value (QLLWL) is reached; and, when said threshold value (QLLWL) is reached, again determining said quantity of fuel so that the fuel mixture during said warm-up operation again reaches the wanted original spacing to the operating limit of the engine.

* * * * *

UNITED STATES PATENT AND TRADEMARK OFFICE

CERTIFICATE OF CORRECTION

PATENT NO. : 5,881,697
DATED : March 16, 1999
INVENTOR(S) : Bernd Schott, et. al.

It is certified that error appears in the above-identified patent and that said Letters Patent is hereby corrected as shown below:

In column 5, line 12: delete "comprising;" and substitute -- comprising: -- therefor.

In column 5, line 24: delete "air," and substitute -- air -- therefor.

In column 5, line 25: delete "(QLL)," and substitute -- (QLL) -- therefor.

Signed and Sealed this

First Day of May, 2001

*Attest:*

Nicholas P. Godici

NICHOLAS P. GODICI

*Attesting Officer*

*Acting Director of the United States Patent and Trademark Office*